US006445263B1

(12) United States Patent
Sonoda et al.

(10) Patent No.: US 6,445,263 B1
(45) **Date of Patent: *Sep. 3, 2002**

(54) DIELECTRIC RESONATOR, DIELECTRIC FILTER, DUPLEXER, AND COMMUNICATION DEVICE

(75) Inventors: Tomiya Sonoda, Muko; Toshiro Hiratsuka, Kusatsu; Yutaka Ida, Otsu; Shigeyuki Mikami; Kiyoshi Kanagawa, both of Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,291

(22) Filed: May 8, 2000

Related U.S. Application Data

(63) Continuation of application No. 09/081,806, filed on May 20, 1998, now Pat. No. 6,104,261.

(30) Foreign Application Priority Data

May 20, 1997 (JP) ..... 9-129614
Apr. 23, 1998 (JP) ..... 10-113296

(51) Int. Cl.[7] ..... H01P 1/213; H01P 1/20
(52) U.S. Cl. ..... 333/134; 333/202

(58) Field of Search ..... 333/219.1, 202, 333/134

(56) References Cited

U.S. PATENT DOCUMENTS 6,016,090 A * 1/2000 Iito et al. ..... 333/202
6,104,261 A * 8/2000 Sonoda et al. ..... 333/202
6,184,758 B1 * 2/2001 Ishikawa et al. ..... 333/202 X

* cited by examiner

*Primary Examiner*—Benny Lee
(74) *Attorney, Agent, or Firm*—Ostrolenk, Faber, Gerb & Soffen, LLP

(57) ABSTRACT

The invention provides. a dielectric resonator for example in the TE010 mode characterized in that electrodes are formed on both principal surfaces of a dielectric plate in such a manner that influence of spurious waves propagating in a space between the electrodes and a conductive plate is prevented thus preventing the reduction in Qo and degradation in the attenuation characteristic in the frequency ranges outside the passband. The inner diameter of the cavity is selected such that when the cavity is regarded as a waveguide the cutoff frequency of the waveguide becomes higher than the resonant frequency of a resonance region and such that the inner diameter of the cavity is greater than a non-electrode part.

8 Claims, 12 Drawing Sheets

DIELECTRIC RESONATOR, DIELECTRIC FILTER, DUPLEXER, AND COMMUNICATION DEVICE

This is a continuation of application Ser. No. 09/081,806, filed May 20, 1998, U.S. Pat. No. 6,104,261.

BACKGROUND OF THE INVENTION

1. Field of the Invention

The present invention relates to a dielectric resonator, a dielectric filter, and a duplexer for use in the microwave or millimeter wave range and also to a communication device using such an element.

2. Description of the Related Art

In recent years, with the increasing popularity of mobile communications systems and multimedia, there are increasing needs for high-speed and high-capacity communications systems. As the quantity of information transmitted via these communications systems increases, the frequency range used in communications is being expanded and increased from the microwave range to the millimeter wave range. Although TE01δ-mode dielectric resonators, which are widely used in the microwave range, can also be used in the millimeter waver range, extremely high accuracy is required in forming resonators because the dimensions of the cylindrical dielectric of the resonator, which determine the resonant frequency of the resonator, become very small in the millimeter wave range. In the case where a filter for use in the millimeter wave range is constructed using TE01δ-mode dielectric resonators, extremely high positioning accuracy is required when TE01δ-mode dielectric resonators are disposed at properly spaced locations in a waveguide. Furthermore, the resonance frequency of each resonator should be adjusted precisely. It is also required that coupling among dielectric resonators be precisely adjusted. However, a very complicated structure is required to perform precise adjustment.

The applicant for the present invention has proposed, in Japanese Patent Application No. 7-62625, a dielectric resonator and a bandpass filter which does not have the above problems.

FIGS. 10A and 10B illustrate the structure of the dielectric resonator disclosed in the patent application cited above, wherein only the essential parts are shown in the figure. In FIGS. 10A and 10B, reference numeral 3 denotes a dielectric substrate having a particular relative dielectric constant. Electrodes 1 and 2 are formed on opposite principal surfaces of the dielectric substrate 3 such that each electrode has a circular-shaped electrodeless areas 4 or 5 whose diameter is properly determined. Conductive plates 17 and 18 are disposed at opposite sides of the dielectric substrate 3 so that they are spaced by a proper distance from the dielectric substrate 3. In this structure, a resonator region 60 with a cylindrical shape is formed in the dielectric substrate 3 and it acts as a TE010-mode dielectric resonator.

In the above dielectric resonator having the structure including electrodes having electrodeless areas with substantially the same shape which are formed on opposite principal surfaces of the dielectric plate disposed between the two conductive plates spaced from each other, spurious waves in a TE mode are generated between the respective electrodes on the principal surfaces of the dielectric plate and the corresponding conductive plates, and the spurious waves propagate in the spaces between the principal surfaces of the dielectric plate and the conductive plates. The spurious waves are reflected by a cavity wall and thus standing waves are generated. This means that resonance associated with such standing waves occurs.

If such TE-mode spurious waves are generated and propagate in the spaces between the respective principal surfaces of the dielectric plate and the conductive plates, energy of TE010-mode resonance which is essential in this dielectric resonator is partially transferred to energy of the spurious waves, and thus the unloaded Q (Qo) becomes low and degradation occurs in the characteristics in the frequency ranges out of the passband of the bandpass filter.

One technique for constructing a dielectric resonator and a bandpass filter which do not have the above problems has been proposed by the applicant for the present invention as disclosed in Japanese Patent Application No. 8-54452.

It is an object of the present invention to provide a dielectric resonator, a dielectric filter, a duplexer, and a communication device using such an element, in which the above-described problems are prevented in a different manner from that employed in Japanese Patent Application No. 8-54452.

SUMMARY OF THE INVENTION

According to an aspect of the present invention, there is provided a dielectric resonator including electrodes formed on opposite principal surfaces of a dielectric plate, electrodeless areas having substantially the same shape being formed in the respective electrodes such that the electrodeless areas are located at positions corresponding to each other on the opposite principal surfaces of the dielectric plate, a region between the electrodeless areas serving as a resonance region, the electrodeless areas being surrounded by a cavity formed inside a conductive case, the dielectric resonator being characterized in that: the dimensions of the cavity are determined so that the cutoff frequency of the cavity is higher than the resonant frequency of the resonance region and so that the size of the cavity is greater than the outer size of the electrodeless areas thereby ensuring that generation of spurious waves in a space between the electrodes on the principal surfaces of the dielectric plate and the inner wall of the cavity.

In the above dielectric resonator, the cavity is preferably formed into a cylindrical shape with an inner diameter 2a which satisfies the condition $a<c/(3.412of)$ where fo is the resonant frequency of the resonance regions and c is the velocity of light.

When the cavity is regarded as a circular waveguide having a radius a, the lowest-order mode of the circular waveguide is TE11, and its cutoff wavelength $\lambda_c$. is given by $\lambda_c=3.412a$. Therefore, if the radius an is selected such that $a<c/(3.412fo)$ where fo is the resonant frequency of the resonant region and c is the velocity of light, then the TE11 wave is cut off and thus the propagation of the TE11 wave in the cavity is suppressed.

The cavity may also be formed into a rectangular shape with a width a which satisfies the condition $a<c/(2fo)$ where fo is the resonant frequency of the resonance regions and c is the velocity of light.

When the cavity is regarded as a rectangular waveguide, the lowest-order mode is TE10, and the cutoff frequency $\lambda_c$ is given by $\lambda_c=2a$. Therefore, if the width an is selected such that $a<c/(2fo)$ where fo is the resonant frequency of the resonant region and c is the velocity of light, then the TE10 wave is cut off and thus the propagation of the TE11 wave in the cavity is suppressed.

According to another aspect of the present invention, there is provided a dielectric filter including electrodes formed on opposite principal surfaces of a dielectric plate, a plurality of electrodeless areas having substantially the same shape being formed in the respective electrodes such that the electrodeless areas on one principal surface of the dielectric plate are located at positions corresponding to the positions of the respective electrodeless areas on the other principal surface on the opposite side, the respective regions between the electrodeless areas serving as resonance regions, said electrodeless areas being surrounded by a cavity formed inside a conductive case, the dielectric filter further including a signal input part and a signal output part which are each coupled with an electromagnetic field in the vicinity of any of the plurality of resonance regions, the dielectric filter being characterized in that the width of the cavity at the boundary part between adjacent electrodeless areas is determined so that the cutoff frequency associated with the boundary becomes higher than the resonant frequency of the resonant regions, thereby ensuring that generation of spurious waves in a space between the electrodes on the principal surfaces of the dielectric plate and the inner wall of the cavity. Thus the resultant dielectric filter is excellent in that large attenuation is achieved in the frequency ranges outside the passband and that spurious waves are suppressed.

The coupling between adjacent resonators formed in the corresponding resonance regions can be adjusted by properly selecting the width of the boundary part of the cavity.

In this dielectric filter, the cavity surrounding the electrodeless areas is preferably formed into a cylindrical shape, and the width e of the boundary part of said cavity is determined such that $e<2/(2fo)$ where fo is the resonant frequency of the resonance regions and c is the velocity of light.

The cavity acts as a waveguide in which the cutoff frequency at the boundary part is given by $c/(2fo)$. Therefore, if the width e is selected such that $e<c/(2fo)$, propagation of spurious waves through the boundary part is suppressed.

According to still another aspect of the invention, there is provided a duplexer characterized in that a dielectric filter comprising a dielectric resonator according to any of aspects of the invention and further comprising a signal input part and a signal output part or a dielectric filter according to the above aspect of the invention is used as a transmitting filter or a receiving filter or both receiving and transmitting filters, the transmitting filter being disposed between a transmission signal input port and an input/output port, the receiving filter being disposed between a received signal output port and the input/output port.

According to still another aspect of the present invention, there is provided a communication device characterized in that it includes an RF circuit having a dielectric resonator according to any of aspects of the invention, a dielectric filter according to any of aspects of the invention, or a duplexer according to the aspect of the invention.

DESCRIPTION OF THE PREFERRED EMBODIMENTS

Figure 1A:
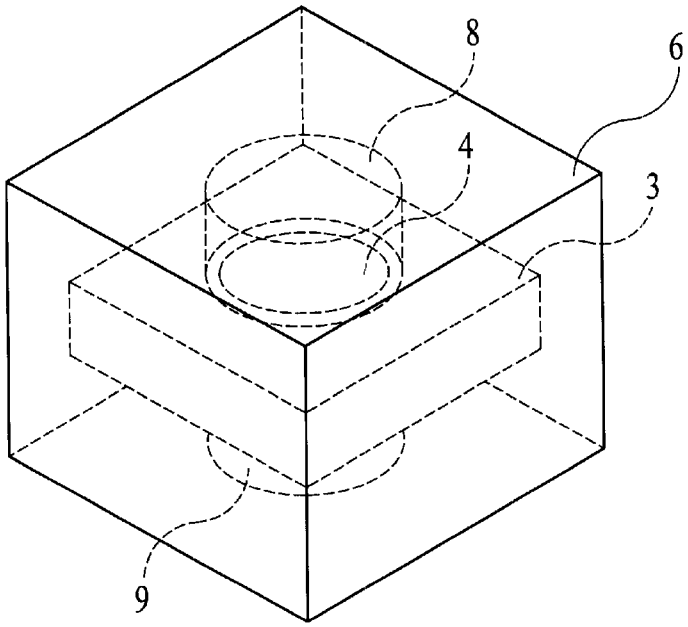
FIGS. 1A and 1B are schematic diagrams illustrating a dielectric resonator according to a first embodiment of the invention.
Figure 1B:
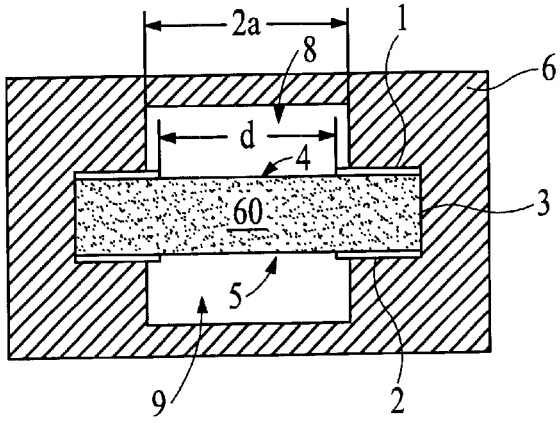

A first embodiment of a dielectric resonator according to the present invention is described below with reference to FIGS. 1A and 1B. FIG. 1A is a perspective view illustrating the external appearance and FIG. 1B is a cross-sectional view thereof. In FIGS. 1A and 1B, reference numeral 3 denotes a dielectric plate. Electrodes 1 and 2 are formed on opposite principal surfaces of the dielectric plate 3. Circular-shaped electrodeless areas 4 and 5 are formed in the respective electrodes 1 and 2 such that the respective electrodeless areas 4 and 5 are located at similar positions on opposite sides of the dielectric plate 3. The region of the dielectric plate 3 between the electrodeless areas 4 and 5 acts as a resonance region 60. The overall structure behaves as a dielectric resonator in the TE010 mode. The dielectric substrate 3 is disposed in a conductor 6 so that cavities 8 and 9 are formed between the conductor 6 and the dielectric plate 3. The cavities 8 and 9 are formed into cylindrical shapes which are coaxial to the electrodeless areas 4 and 5.

When the cavities 8 and 9 are regarded as circular waveguides whose inner diameter is 2a, the lowest-order mode of these circular waveguides is TE11, and their cutoff wavelength $\lambda_c$ is given by $$\lambda_c=3.412a \tag{1}$$

When the resonant frequency of the resonance region 60 is denoted by fo and the velocity of light is denoted by c, the inner diameter 2a (see FIG. 1B) of the cavities 8 and 9 is selected such that $$a<c/(3.412fo) \tag{2}$$

thereby ensuring that the TE11-mode cutoff frequency is higher than the resonant frequency of the resonance region 60. Furthermore, the inner diameter 2a is selected so that it is greater than the diameter d of the electrodeless areas 4 and 5. When the resonant frequency of the resonator is for example 20 GHz, inequality (2) becomes $2a<8.8$ mm. That is, the inner diameter of the cavities 8 and 9 should be smaller than 8.8 mm. In practice, the cutoff frequency is selected to be 1.5 to 2 times the above theoretical value so as to have a sufficient margin thereby ensuring that the principal electromagnetic field in the TE010 mode is prevented from expanding into the cavities (in other words so that the electromagnetic field is confined within the dielectric plate). If the cutoff frequency is selected to be 1.5 times the theoretical value, then the inner diameter 2a of the cavities 8 and 9 becomes 5.8 mm.

Figure 2A:
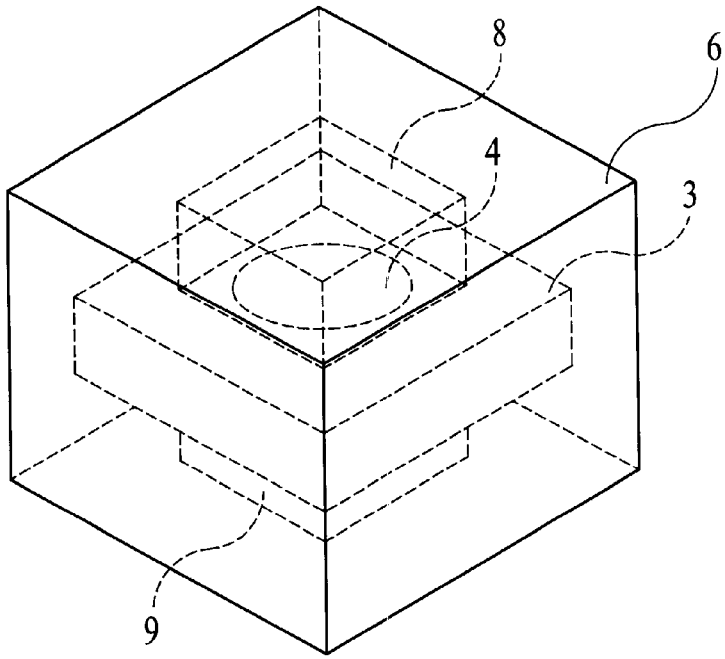
FIGS. 2A and 2B are schematic diagrams illustrating a dielectric resonator according to a second embodiment of the invention.
Figure 2B:
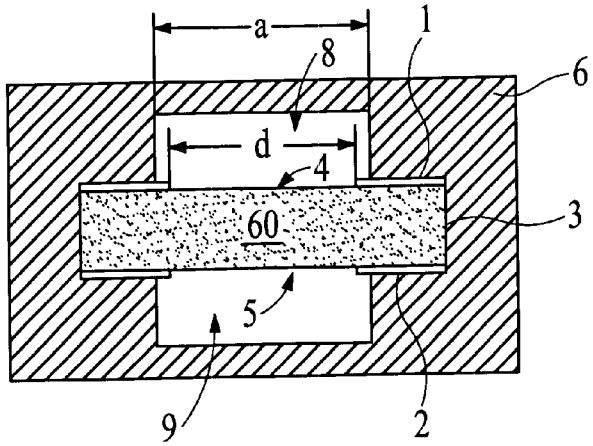

FIGS. 2A and 2B illustrates the construction of a second embodiment of a dielectric resonator according to the invention. This dielectric resonator is different from that shown in FIGS. 1A and 1B in that the cavities 8 and 9 formed between the conductor 6 and the dielectric plate 3 have a rectangular shape. When the cavities 8 and 9 are regarded as rectangular waveguides, their lowest-order mode is TE10, and the cutoff frequency 80 $_c$ is given by $$\lambda_c=2a$$

When the resonant frequency of the resonance region 60 is denoted by fo and the velocity of light is denoted by c, the inner size an of the cavities 8 and 9 is selected such that $$a<c/(2\text{fo}) \tag{3}$$

thereby ensuring that the TE10-mode cutoff frequency is higher than the resonant frequency of the resonance region 60. Furthermore, the inner size of the cavities is selected so that it is greater than the diameter d of the electrodeless areas 4 and 5 (see FIG. 28). When the resonant frequency of the resonator is for example 20 GHz, inequality (2) becomes a<7.5 mm. That is, the inner size of the cavities 8 and 9 should be smaller than 7.5 mm. In practice, the cutoff frequency is selected to be 1.5 to 2 times the above theoretical value so as to have a sufficient margin. If the cutoff frequency is selected to be 1.5 times the theoretical value, then the inner size an of the cavities 8 and 9 become 5 mm.

The spurious waves in the TE10 or TE11 mode are suppressed by selecting the size of the cavities in the above described manner thereby preventing the energy in the principal TE010 mode from being transferred to the spurious mode thus preventing degradation in Qo.

Figure 3A:
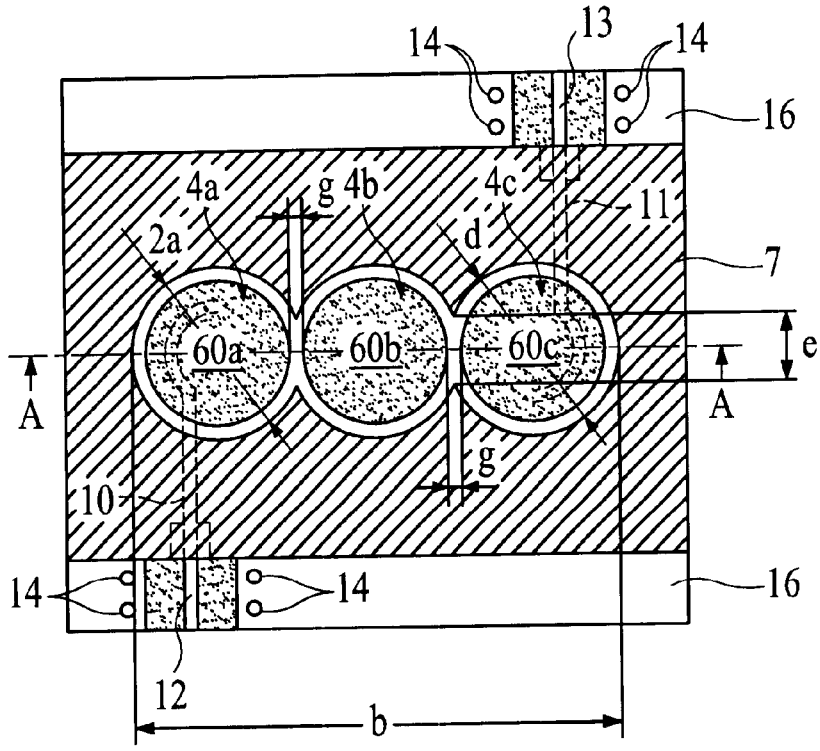
FIGS. 3A and 3B are schematic diagrams illustrating a dielectric filter according to a third embodiment of the invention.
Figure 3B:
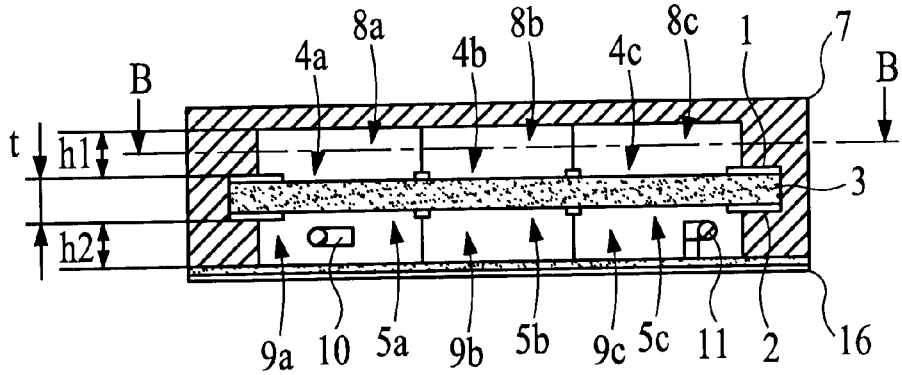
Figure 4A:
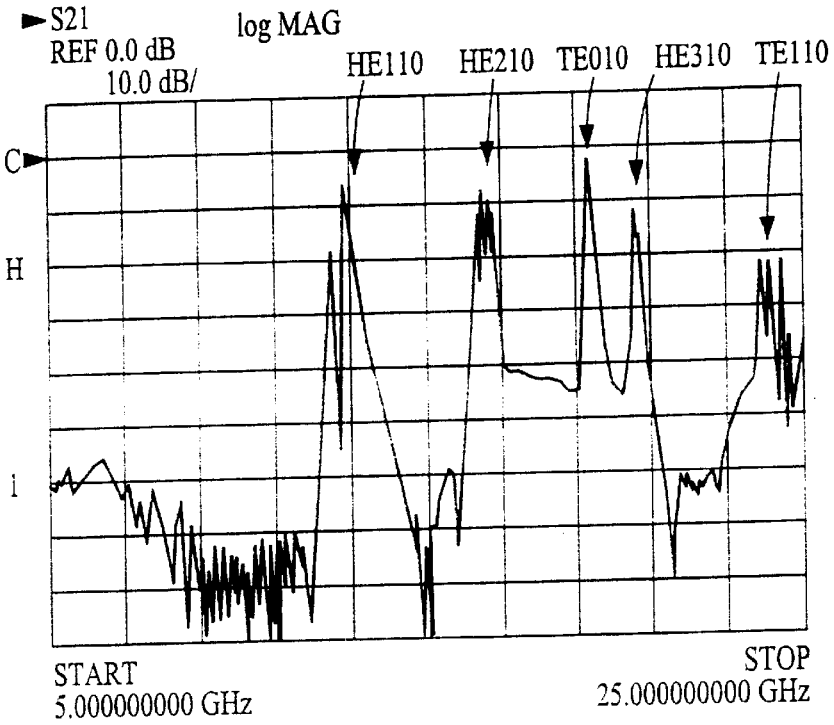
FIGS. 4A and 4B respectively are graphs illustrating the characteristic of the dielectric filter shown in FIGS. 3A, 3B, and the prior art filter shown in FIGS. 9A and 9B.

Referring now to FIGS. 3A, 3B, 4A, a third embodiment of an dielectric filter according to the invention is described below.

FIGS. 3A and 3B are cross-sectional views illustrating the inner structure of the dielectric filter, wherein FIG. 3A is a cross-sectional view taken along the line B—B of FIG. 3B and FIG. 3B is a cross-sectional view taken along the line A—A of FIG. 3A. In FIGS. 3A and 3B, reference numeral 3 denotes a dielectric plate. Electrodes 1 and 2 are formed on opposite principal surfaces of the dielectric plate 3, wherein each electrode has circular-shaped electrodeless areas 4*a*, 4*b*, and 4*c* or 5*a*, 5*b*, and 5*c*, each of which has a diameter d (see FIG. 3A). The electrodeless areas 4*a*, 4*b*, and 4*c* are located on one principal surface of the dielectric plate 3 while the electrodeless areas 5*a*, 5*b*, and 5*c* are located at positions corresponding to 4*a*, 4*b*, and 4*c*, respectively, on the opposite principal surface so that three resonance regions 60*a*, 60*b*, and 60*c* are formed. In FIGS. 3A and 3B, reference numeral 7 denotes a case and 16 denotes a base plate. The dielectric plate 3 is disposed in the case 7 and the opening of the case is covered with the base plate 16. Cavities 8*a*, 8*b*, and 8*c* are formed between the case and the dielectric plate 3, and cavities 9*a*, 9*b*, and 9*c* are formed between the dielectric plate 3 and the base plate 16, wherein the cavities 8*a*, 8*b*, 8*c* are coaxial to the electrodeless areas 4*a*, 4*b*, and 4*c*, respectively, and the cavities 9*a*, 9*b*, and 9*c* are coaxial to the electrodeless areas 5*a*, 5*b*, and 5*c*, respectively. The cavities 8*a*, 8*b*, and 8*c* are continuous at boundaries with a small width e between adjacent cavities. Similarly, the cavities 9*a*, 9*b*, and 9*c* are continuous at the respective boundaries.

When the resonant frequency of the resonance regions 60*a*, 60*b*, and 60*c* is denoted by fo, and the velocity of light is denoted by c, the inner diameter 2a of the cavities 8*a*, 8*b*, 8*c*, 9*a* and 9*c* are selected such that inequality (2) is satisfied thus ensuring that the cutoff frequency of the cavities is higher than the resonant frequency fo. Furthermore, the inner diameter 2a is selected to be greater than the diameter d of the electrodeless areas.

When the above-described cavities are regarded as waveguides, the cutoff wavelength $\lambda_c$ at the boundaries with the width e between adjacent cavities is given by $$\lambda_c=2e \tag{4}$$

Therefore, when the resonant frequency of the resonance regions is fo, if the width. e of the boundaries is set to become smaller than c/(2fo), then the spurious waves in the TE10 mode propagating through the boundaries of the cavities are suppressed. For example, when fo=20 GHz, e is selected to be smaller than 7.5 mm.

Because the spurious waves can be suppressed by properly selecting the width e of the boundaries between cavities as described above, it is not necessarily required that inequality (2) be satisfied, if equation (4) is satisfied.

The base plate 16 shown in FIGS. 3A and 3B is made of an insulating or dielectric plate on which electrode patterns are properly formed. A ground electrode is formed over the substantially whole area of the bottom surface (on the lower side in FIGS. 3A and 3B) of the base plate 16. Ground electrodes and microstrip lines 12 and 13 are formed on the upper surface of the parts of the base plate 16 extending outward from the case 7. Probes 10 and 11 are connected via solder or the like to the ends of the respective microstrip lines 12 and 13. As best shown in FIG. 3A, in the vicinity of the microstrip lines 12 and 13, through-holes 14 are formed which extend through the base plate 16 so that the ground electrodes formed on the upper and lower surfaces of the base plate 16 are electrically connected to each other thereby ensuring that there is no difference in ground potential between the upper and lower ground electrodes in the areas near the microstrip lines thus preventing spurious waves from being generated in these areas.

In the structure shown in FIGS. 3A and 3B, the probes 10 and 12 are magnetically coupled with the resonance regions 60*a* and 60*c*, respectively. The adjacent resonance regions 60*a* and 60*b* are magnetically coupled with each other via the space between the adjacent resonance regions. The adjacent resonance regions 60*b* and 60*c* are also magnetically coupled with each other in a similar manner.

Figure 9A:
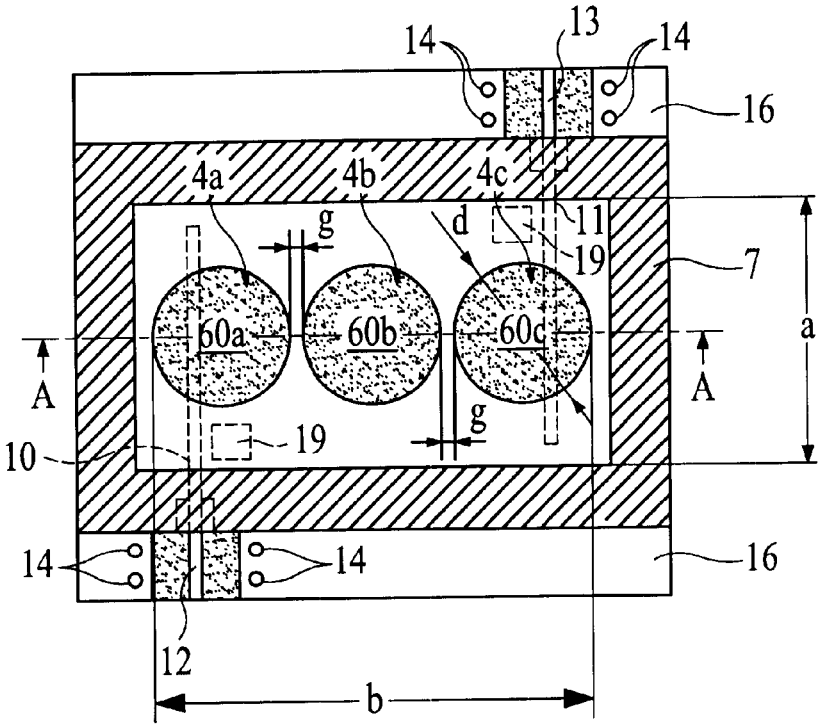
FIG. 9A PRIOR ART
FIGS. 9A and 9B are schematic diagrams illustrating a dielectric filter according to a conventional technique.
Figure 9B:
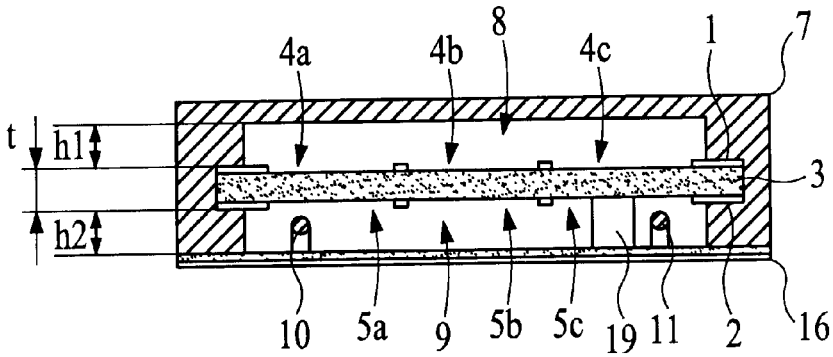
FIG. 9B PRIOR ART
Figure 10A:
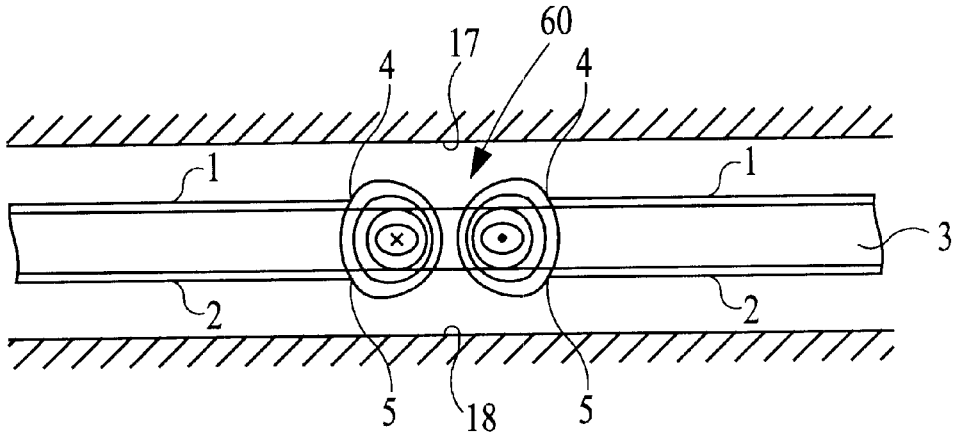
FIG. 10A PRIOR ART
FIGS. 10A and 10B are schematic diagrams illustrating an example of the structure of a dielectric resonator according to a conventional technique wherein the electromagnetic field distribution is also shown in the figure.
Figure 10B:
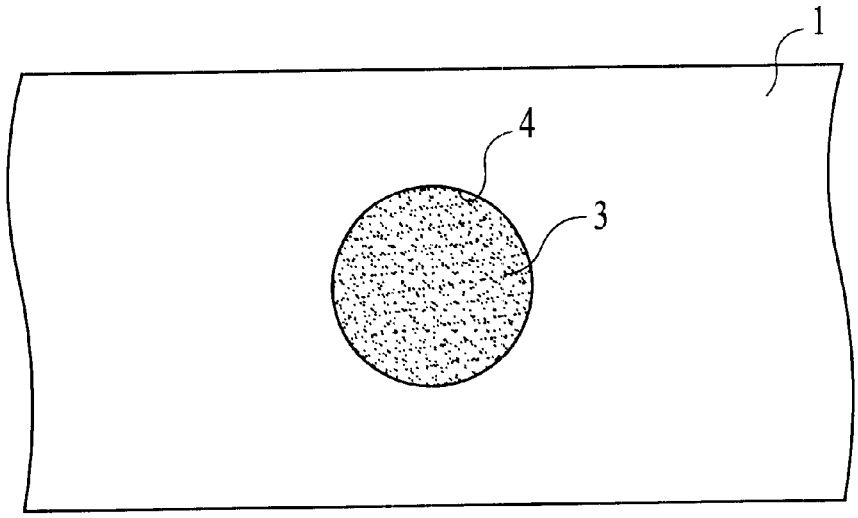
FIG. 10B PRIOR ART

For the purpose of comparison with the dielectric filter shown in FIGS. 3A and 3B, there is provided a cross-sectional view in FIGS. 9A and 9B, which illustrates the structure of a dielectric filter according to a conventional technique. Unlike the dielectric filter shown in FIGS. 3A and 3B, cavities 8 and 9 are formed on the upper and lower sides of a dielectric plate 3 in such a manner that the cavity wall is similar in shape to the outer wall of the case 7. In FIGS. 9A and 9B, reference numeral 19 denotes a spurious wave suppression plate disposed at a proper location between the base plate 16 and the electrode 2 formed on the lower surface of the dielectric plate 3 so that an LC circuit (LC resonator) is formed between the electrode 2 and the ground electrode at the location where the spurious wave suppression plate 19 is located. This technique using such a spurious wave suppression plate falls within the scope of Japanese Patent Application No. 8-54452 cited above.

The dimensions of various parts of the dielectric filters shown in FIGS. 3A, 3B, 9A and 9B are listed below, wherein the relative dielectric constant $\in_r$ is also shown.

TABLE 1

| | FIGS. 3A, 3B | FIGS. 9A, 9B |
|---|---|---|
| Inner Diameter 2a | 5.5 | — |
| Width a | — | 8.0 |
| h1 | 1.0 | 1.5 |
| h2 | 1.0 | 2.0 |
| t | 1.0 | 1.0 |
| g | 0.5 | 0.7 |
| $\epsilon r$ | 30 | 30 |
| d | 4.4 | 4.0 |
| e | 2.5 | — |
| b | 15.3 | 18.0 |

Figure 4B:
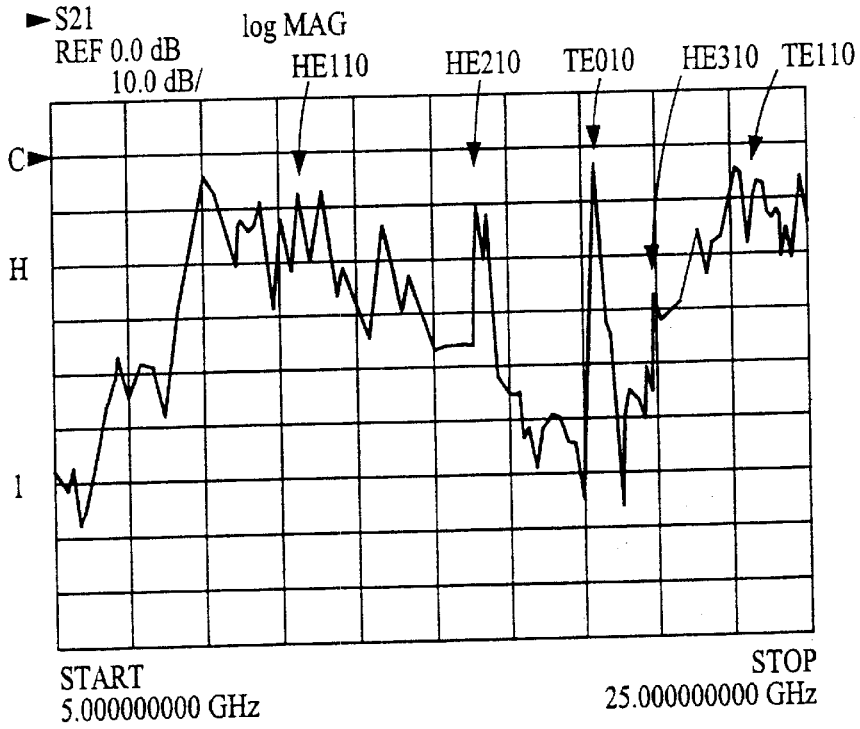
FIG. 4B PRIOR ART

FIGS. 4A and 4B illustrate the attenuation-frequency characteristic for both dielectric filters shown in FIGS. 3A, 3B, 9A and 9B, wherein the characteristic of the dielectric filter of FIGS. 3A and 3B is shown in FIG. 4A and the characteristic of the dielectric filter of FIGS. 9A and 9B is shown in FIG. 4B.

In the dielectric filter shown in FIGS. 9A and 9B, when the length b along the longer sides of the case 7 is regarded as the width of the waveguide, the lowest-order resonance in the TE10 mode can occur in this direction of the waveguide. In this specific example, b=18.0, thus the cutoff frequency in the TE01 mode is 8.3 GHz. In fact, a resonance peak corresponding to this cutoff frequency appears within the range of 8 to 9 GHz as shown in FIG. 4B. When the length an along the shorter sides of the case 7 is regarded as the width of the waveguide, the cutoff frequency in the TE10 mode can be calculated as fc=18.8 GHz because a=8.0. In FIG. 4B, however, attenuation occurs at this frequency. This is because the LC circuit formed with the spurious wave suppression plate 19 shown in FIG. 9A acts as a trap filter which traps the signal in the range of 18 to 20 GHz. If the spurious wave suppression plate is not provided, resonance in the TE10 mode occurs near 18.8 GHz, and the frequency range near 18.8 GHz becomes a passband, and thus the filter does not function as a TE010-mode filter.

In the case of the dielectric filter shown in FIGS. 3A and 3B, if the cavities. with the total length b of 15.3 mm are assumed to act as a whole as a wavelength with a width of 15.3 mm, then resonance in TE10 mode occurs near 9.8 GHz. However, the inner shape of the case is formed in such a manner as to be similar to the shape of the TE010-mode resonator parts and thus the width e is as small as 2.5 mm. As a result, fc in the TE10 mode becomes higher than 30 GHz, and attenuation greater than 70 dB is achieved in the frequency range of 9 to 11 GHz as shown in FIG. 4A. On the other hand, the cutoff frequency fc associated with resonance in the TE11 mode corresponding to the diameter 2a shown in FIGS. 3A and 3B can be calculated as about 32 GHz from inequality (2) with 2a=5.5 mm. Therefore, no influence of the resonance in this mode is seen in FIG. 4A.

Thus, in the structure shown in FIGS. 3A and 3B, attenuation greater than 40 dB is achieved over the wide frequency range from DC to 25 GHz except for resonance peaks corresponding to the spurious resonance in the HE110, HE210, HE310, and TE110 modes which occur in the resonance regions.

As can be seen from the above description, if the inner structure and dimensions of the case are determined as shown in FIGS. 3A and 3B, the cutoff frequency can fall within the frequency range of interest without having to use the spurious wave suppression plate such as that shown in FIGS. 9A and 9B, and thus a filter with a desired characteristic can be easily realized. This makes it possible to produce a filter with a reduced number of components. The reduction in the number of components results in a reduction in production cost and results in an improvement in reliability.

Figure 5A:
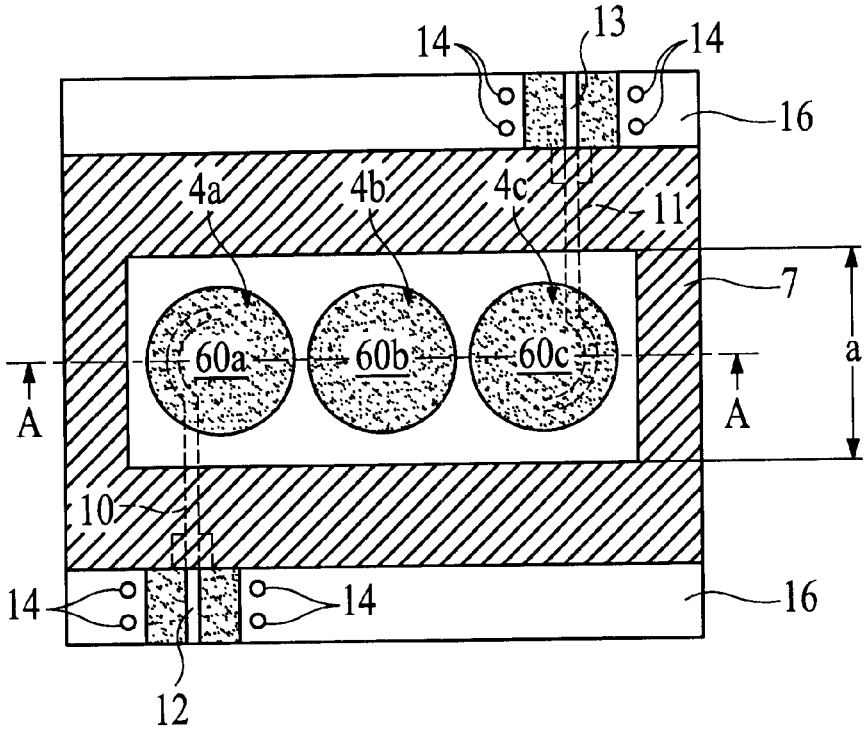
FIGS. 5A and 5B are schematic diagrams illustrating a dielectric filter according to a fourth embodiment of the invention.
Figure 5B:
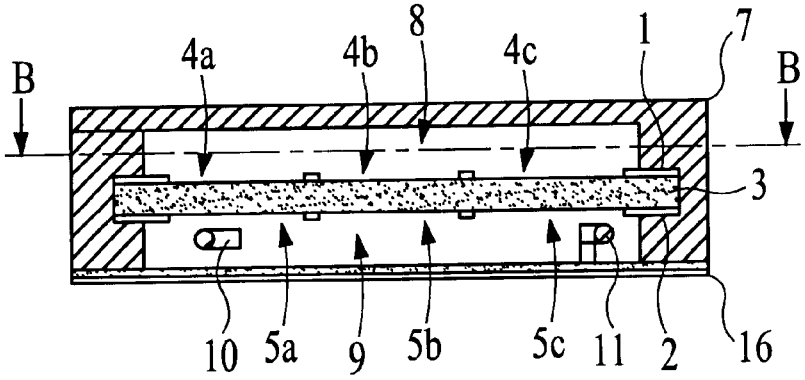

Referring now to FIGS. 5A and 5B, a fourth embodiment of a dielectric filter according to the invention is described below. In this embodiment, unlike the structure shown in FIGS. 3A and 3B, cavities 8 and 9 (see FIG. 5B) are formed on the upper and lower sides, respectively, of a dielectric plate 3 in such a manner that the cavities 8 and 9 have a fixed width an over the entire length of the cavities in which three resonator regions 60*a*, 60*b*, and 60*c* (see FIG. 5A) are located. The width a is selected so that inequality (3) described earlier is satisfied. Furthermore, the width a of the cavities is selected to be greater than the diameter d of the non-electrode parts. The other parts are similar to those shown in FIGS. 3A and 3B.

Figure 6A:
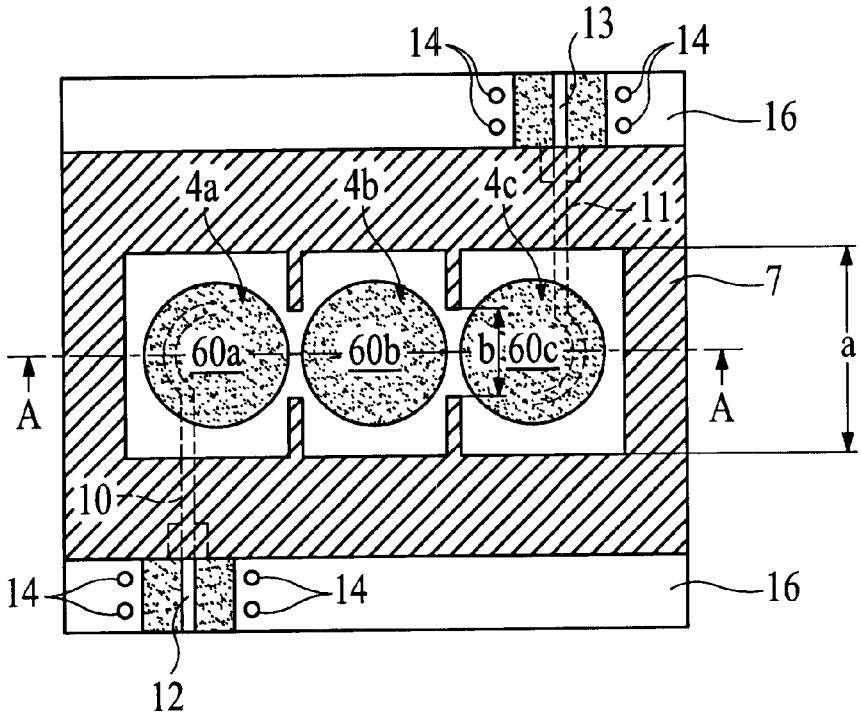
FIGS. 6A and 6B are schematic diagrams illustrating a dielectric filter according to a fifth embodiment of the invention.
Figure 6B:
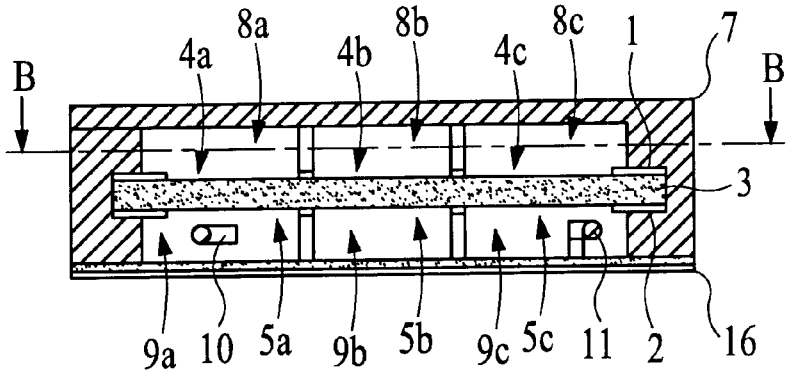

FIGS. 6A and 6B illustrate the structure of a dielectric filter according to a fifth embodiment of the invention. The difference from that shown in FIGS. 5A and 5B is that cavities 8*a*, 8*b*, and 8*c* are formed on the upper sides of resonance regions 60*a*, 60*b*, and 60*c*, respectively, and cavities 9*a*, 9*b*, and 9*c* are formed on the lower sides of resonance regions 60*a*, 60*b*, and 60*c*, respectively, wherein boundary parts between adjacent cavities are narrowed to a width b. The other parts are similar to those shown in FIGS. 5A and 5B. By narrowing the boundary portions between adjacent cavities to a width b, (see FIG. 6A) propagation of spurious waves through the boundary portions in the cavities is further suppressed. The coupling between the adjacent resonance regions can be adjusted by varying the width b of the narrowed portions. That is, if the width b is reduced while maintaining the space between the adjacent non-electrode parts unchanged, the coupling between the adjacent resonance regions decreases. Conversely, if the width b is increased, the coupling between the adjacent resonance regions increases.

Figure 7A:
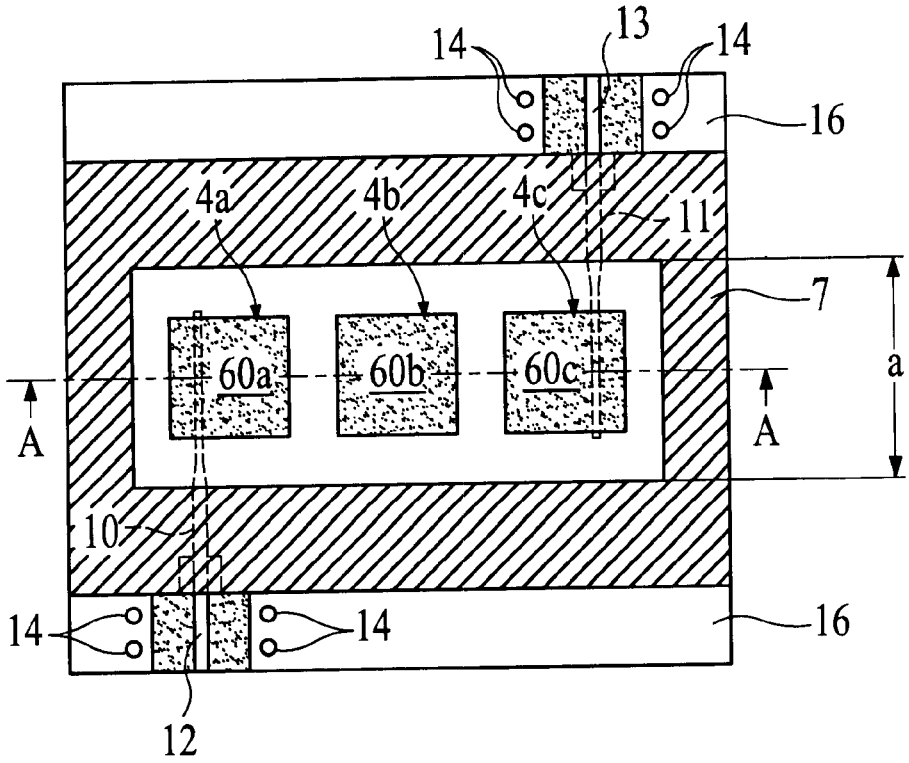
FIGS. 7A and 7B are schematic diagrams illustrating a dielectric filter according to a sixth embodiment of the invention.
Figure 7B:
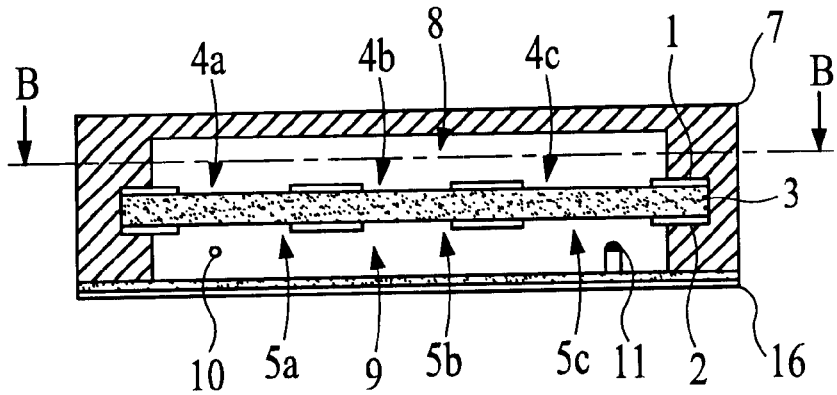

FIGS. 7A and 7B are cross-sectional views illustrating the structure of a dielectric filter according to a sixth embodiment of the invention. The difference from that shown in FIGS. 5A and 5B is that the electrodeless areas 4*a*, 4*b*, 4*c*, 5*a*, 5*b*, and 5*c* are formed into rectangular shapes and that the probes 10 and 11 are formed into a shape extending straight over the entire length to their end portions. The other parts are similar to those shown in FIGS. 5A and 5B. If the electrodeless areas are formed into rectangular shapes, the respective resonance regions 60*a*, 60*b*, and 60*c* acts as dielectric resonators in the TE100 mode. The probes 10 and 11 are magnetically coupled with the resonators in the resonance regions 60*a* and 60*c*, respectively. The adjacent resonators in the resonance regions 60*a* and 60*c* are magnetically coupled with each other. Similarly, the adjacent resonators in the resonance regions 60*b* and 60*c* are also magnetically coupled with each other.

Figure 8A:
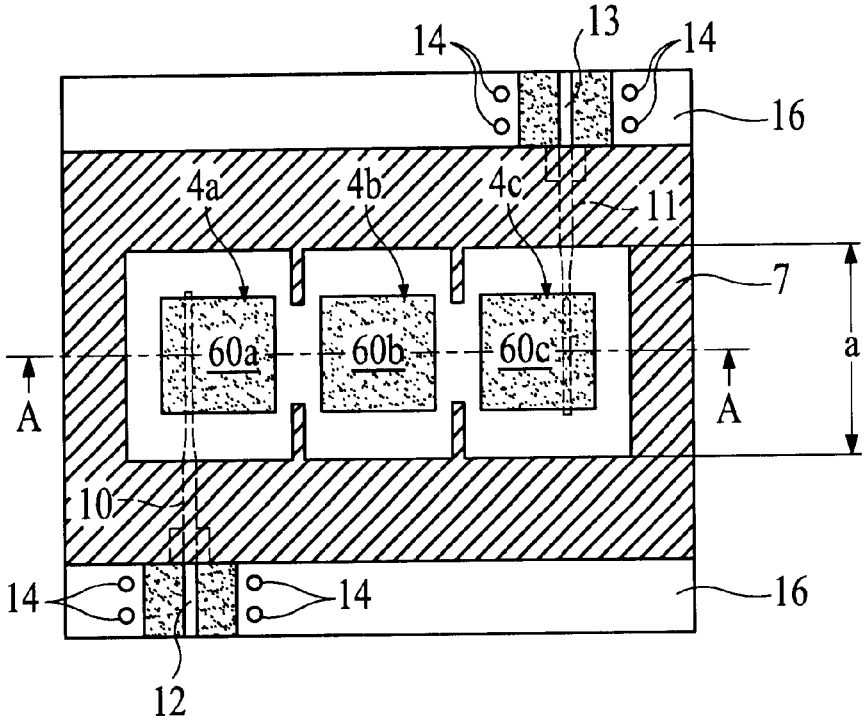
FIGS. 8A and 8B are schematic diagrams illustrating a dielectric filter according to a seventh embodiment of the invention.
Figure 8B:
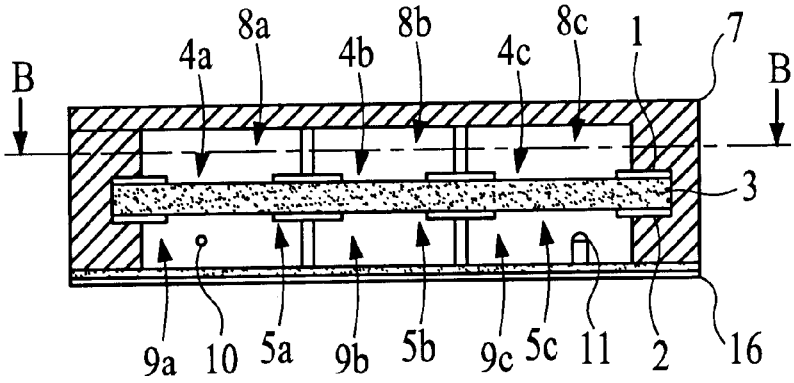

FIGS. 8A and 8B are cross-sectional views illustrating the structure of a dielectric filter according to a seventh embodiment of the invention. The difference from that shown in FIGS. 7A and 7B is that cavities 8*a*, 8*b*, and 8*c* are formed on the upper sides of resonance regions 60*a*, 60*b*, and 60*c*, respectively, and cavities 9*a*, 9*b*, and 9*c* are formed on the lower sides of resonance regions 60*a*, 60*b*, and 60*c*, respectively, wherein boundary parts between adjacent cavities are narrowed. The other parts are similar to those shown in FIGS. 7A and 7B. By narrowing the boundary portions between adjacent cavities, propagation of spurious waves through the boundary portions in the cavities is further suppressed. The coupling between the adjacent resonators can be adjusted by varying the width of the narrowed portions.

Figure 11:
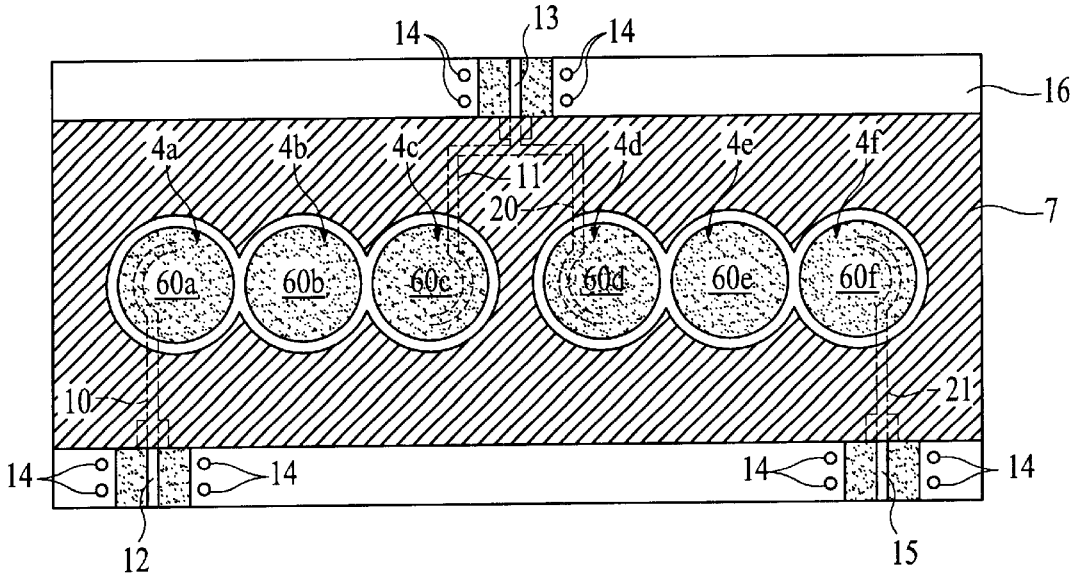
FIG. 11 is a schematic diagram illustrating a duplexer according to the invention.

Referring now to FIG. 11, a duplexer according to an eighth embodiment of the invention is described below.

Probes 10, 11, 20, and 21 are disposed below the dielectric plate. The probes 11 and 20 are formed by separating a single element into two parts. The inner shape of the case 7 is determined so that there are spaces surrounding the respective probes not only in those region where the probes are coupled with the dielectric resonators but over the entire probes.

The probe 10 is magnetically coupled with the resonance region 60*a* formed on the electrodeless area 4*a*. The probe 21 is magnetically coupled with the resonance region 60*f* formed on the electrodeless area 4*f*. The probes 12 and 20 are magnetically coupled with the resonance regions 60*c* and 60*d* formed on the electrodeless areas 4*c* and 4*d*, respectively.

A receiving filter is formed with three resonance regions 60*a*, 60*b*, and 60*c* located on one side, and transmitting filter is formed with the remaining three resonance regions 60*d*, 60*e*, and 60*f* located on the other side. A part of the case 7 extends between the resonance region 60*c* serving as the first stage of the receiving filter and the resonance region 60*d* serving as the final stage of the transmitting filter so as to ensure that the receiving filter and the transmitting filter are well isolated from each other.

The electrical length from the equivalently short-circuited plane of the resonance region 60*c* to the branch point of the probes 11 and 20 is selected to be an odd multiple of ¼ times the wavelength, as measured on the transmission line, of the transmission frequency. The electrical length from the equivalently short-circuited plane of the resonance region 60*d* to the branch point of the probes 11 and 20 is selected to be an odd multiple of ¼ times the wavelength, as measured on the transmission line, of the reception frequency.

This structure allows the transmission signal and the reception signal to be separated while spurious waves propagating in the spaces above and below the dielectric plate are suppressed in both the reception filter and transmission filter.

Figure 12:
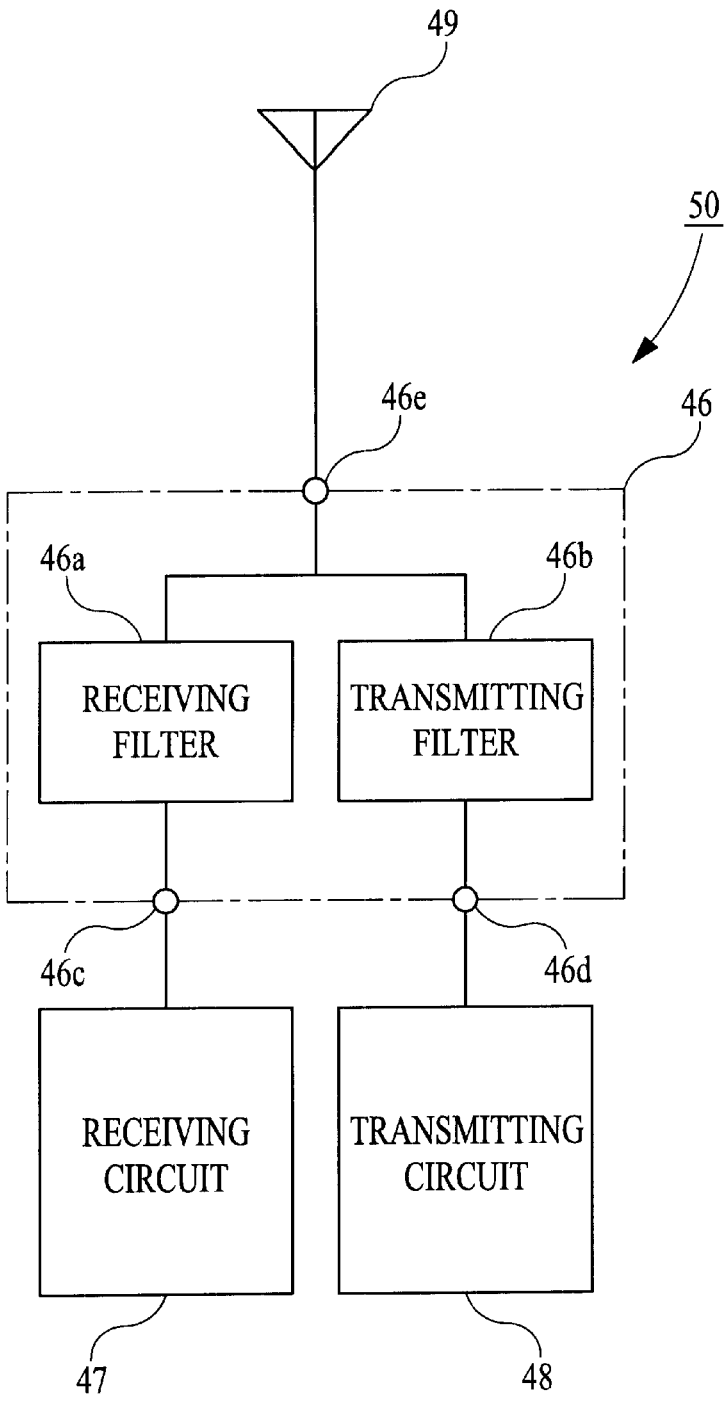
FIG. 12 is a block diagram illustrating a communication device according to the invention.

FIG. 12 is a block diagram illustrating a communication device according to a ninth embodiment of the invention.

In this communication device shown in FIG. 12, a duplexer according to the eighth embodiment described above is used as an antenna duplexer. In FIG. 12, reference numerals 46*a* and 46*b* denote receiving and transmitting filters, respectively, which form an antenna duplexer 46. As shown in FIG. 12, a receiving circuit 47 is connected to the received signal output port 46*c* of the antenna duplexer 46, and a transmitting circuit 48 is connected to the transmitting signal port 46*d*. Furthermore, an antenna 49 is connected to the input/output port 46*e* so that the overall structure serves as a communication device 50.

By employing the antenna duplexer having excellent characteristics in terms of the spurious suppression and separation between the transmission and reception signals, a small-sized high-performance communication device can be realized.

Although in the embodiment shown in FIG. 12, the duplexer according to the present invention is employed in the communication device, any of the above-described dielectric resonators or dielectric filters according to the invention may be employed in the RF circuit of the communication device. This makes it possible to realize a communication device having an RF circuit with low spurious effects.

As can be understood from the above description, the present invention has the following advantages. In the resonator according to the invention, generation of spurious waves in the spaces between the inner cavity wall and the electrodes and the principal surfaces of the dielectric plate is suppressed. As a result, transfer of energy to the spurious mode is suppressed thus preventing the reduction in unloaded Q of the dielectric resonator.

Furthermore, the shape of the cavities is selected so that generation of spurious waves is suppressed in a further effective fashion.

In the filter according to the invention, spurious waves are suppressed and degradation in the attenuation characteristic in the frequency ranges outside the passband is prevented.

In the duplexer according to the invention, good attenuation characteristic is achieved in the frequency ranges outside the passband.

In the communication device according to the invention, good characteristics without being affected by spurious effects are achieved in the RF circuit of the communication device. The resultant communication device is small in size and high in efficiency.

What is claimed is:

1. A duplexer comprising:

a transmitting dielectric filter and a receiving dielectric filter, each of said dielectric filters comprising first and second electrodes disposed on respective first and second opposed principal surfaces of a dielectric plate, a plurality of electrodeless area pairs, each electrodeless area pair including first and second opposed electrodeless areas formed in said first and second electrodes, respectively, to define a respective resonance region therebetween, each electrodeless area of a given pair having the same shape as the other electrodeless area of that pair, each electrodeless area of a given pair being surrounded by a respective cavity including two opposing walls, wherein a respective maximum distance a between said walls satisfies the condition $a<c/(2f0)$) where f0 is the resonant frequency of said resonance region defined by said pair and c is the velocity of light.

2. A communication device comprising:

a duplexer which includes a transmitting dielectric filter and a receiving dielectric filter, each of said dielectric filters comprising first and second electrodes disposed on respective first and second opposed principal surfaces of a dielectric plate, a plurality of electrodeless area pairs, each electrodeless area pair including first and second opposed electrodeless areas formed in said first and second electrodes, respectively, to define a respective resonance region therebetween, each electrodeless are of a given pair having the same shape as the other electrodeless area of that pair, each electrodeless area of a given pair being surrounded by a respective cavity including two opposing walls, wherein a respective maximum distance a between said walls satisfies the condition $a<c/(2f0)$ where f0 is the resonant frequency of said resonance region defined by said given pair and c is the velocity of light, each of said transmitting dielectric filter and said receiving dielectric filter further including a respective signal input and a respective signal output;

said signal output of said transmitting dielectric filter and said signal input of said receiving dielectric filter being connected to an antenna terminal;

said signal input of said transmitting dielectric filter being connected to a transmitter terminal; and said signal output of said receiving dielectric filter being connected to a receiver terminal.

3. A communication device comprising:

a transmitter;

a receiver; and a duplexer which includes a transmitting dielectric filter and a receiving dielectric filter, each of said dielectric filters comprising first and second electrodes disposed on respective first and second opposed principal surfaces of a dielectric plate, a plurality of electrodeless area pairs, each electrodeless area pair including first and second opposed electrodeless areas formed in said first and second electrodes, respectively, to define a respective resonance region therebetween, each electrodeless area of a given pair having the same shape as the other electrodeless area of that pair, each electrodeless area of a given pair being surrounded by a respective cavity including two opposing walls, wherein a respective maximum distance a between said walls satisfies the condition $a<c/(2f0)$ where f0 is the resonant frequency of said resonance region defined by said given pair and c is the velocity of light, each of said transmitting dielectric filter and said receiving dielectric filter further including a respective signal input and a respective signal output;

said transmitter being coupled to said signal input of said transmitting dielectric filter, said receiver being coupled to said signal output of said receiving dielectric filter.

4. A communication device comprising:

a transmitter;

a receiver; and a duplexer which includes a transmitting dielectric filter and a receiving dielectric filter, each of said dielectric filters comprising first and second electrodes disposed on respective first and second opposed principal surfaces of a dielectric plate, each electrode including a respective electrodeless area located therein, each said electrodeless area having substantially the same shape as the other of said electrodeless areas and being opposed to the other of said electrodeless areas so as to define a resonance region therebetween, each of said electrodeless areas being surrounded by a respective cavity, each said cavity including two opposing walls, wherein a respective maximum distance a between said walls satisfies the condition $a<c/(2f0)$ where f0 is the resonant frequency of said resonance region and c is the velocity of light, each of said transmitting dielectric filter and said receiving dielectric filter further including a respective signal input and a respective signal output;

said transmitter being coupled to said signal input of said transmitting dielectric filter, said receiver being coupled to said signal output of said receiving dielectric filter.

5. A duplexer comprising:

a transmitting dielectric filter and a receiving dielectric filter, each of said dielectric filters comprising first and second electrodes disposed on respective first and second opposed principal surfaces of a dielectric plate, each electrode including a respective electrodeless area located therein, each said electrodeless area having substantially the same shape as the other of said electrodeless areas and being opposed to the other of said electrodeless areas so as to define a resonance region therebetween, each of said electrodeless areas being surrounded by a respective cavity, each said cavity having at least two opposing walls, wherein a respective maximum distance a between said walls satisfies the condition $a<c(2f0)$ where f0 is the resonant frequency of said resonance region and c is the velocity of light, each of said transmitting dielectric filter and said receiving dielectric filter further including a respective signal input and a respective signal output.

6. A communication device comprising:

a duplexer which includes a transmitting dielectric filter and a receiving dielectric filter, each of said dielectric filters comprising first and second electrodes disposed on respective first and second opposed principal surfaces of a dielectric plate, each electrode including a respective electrodeless area located therein, each said electrodeless area having substantially the same shape as the other of said electrodeless areas and being opposed to the other of said electrodeless areas so as to define a resonance region therebetween, each of said electrodeless areas being surrounded by a respective cavity, each said cavity including two opposing walls, wherein a respective maximum distance a between said walls satisfies the condition $a<c/(2f0)$ where f0 is the resonant frequency of said resonance region and c is the velocity of light, each of said transmitting dielectric filter and said receiving dielectric filter further including a respective signal input and a respective signal output;

said signal output of said transmitting dielectric filter and said signal input of said receiving dielectric filter being connected to an antenna terminal;

said signal input of said transmitting dielectric filter being connected to a transmitter terminal; and said signal output of said receiving dielectric filter being connected to a receiver terminal.

7. A communication device according to claim 6, further comprising a transmitter and a receiver connected respectively to said transmitter terminal and said receiver terminal.

8. A communication device according to claim 7, further comprising an antenna connected to said antenna terminal.

* * * * *